US005822891A

United States Patent [19]

Fujishima et al.

[11] Patent Number: 5,822,891

[45] Date of Patent: Oct. 20, 1998

[54] WORK AREA LIMITATION CONTROL SYSTEM FOR CONSTRUCTION MACHINE

[75] Inventors: Kazuo Fujishima, Ibaraki-ken; Hiroshi Watanabe, Ushiku; Masakazu Haga, Ibaraki-ken, all of Japan

[73] Assignee: Hitachi Construction Machinery Co., Ltd., Tokyo, Japan

[21] Appl. No.: 768,471

[22] Filed: Dec. 18, 1996

[30] Foreign Application Priority Data

Dec. 27, 1995 [JP] Japan ..... 7-341448

[51] Int. Cl.[6] ..... E02F 5/02

[52] U.S. Cl. ..... 37/348; 37/382; 701/50; 414/699

[58] Field of Search ..... 37/348, 382, 414; 172/2, 3, 5, 6; 414/699, 694; 701/50; 137/625.61

[56] References Cited

U.S. PATENT DOCUMENTS

| | | | |
|---|---|---|---|
| 3,599,673 | 8/1971 | Lucien | 137/625.61 |
| 3,911,602 | 10/1975 | Trevathan | 37/348 |
| 4,242,942 | 1/1981 | Bartholomaus et al. | 91/358 R |
| 4,565,221 | 1/1986 | Yoshida et al. | 137/885 |
| 4,706,932 | 11/1987 | Yoshida et al. | 251/31 |
| 5,136,928 | 8/1992 | Hachisu | 91/392 |
| 5,392,539 | 2/1995 | Hirata et al. | 37/348 |
| 5,433,076 | 7/1995 | Sugiyama et al. | 60/426 |
| 5,479,729 | 1/1996 | Eslambolchi | 37/348 X |
| 5,490,081 | 2/1996 | Kuromoto et al. | 701/50 |
| 5,497,805 | 3/1996 | Sunamura et al. | 137/596.16 |

FOREIGN PATENT DOCUMENTS

| | | | |
|---|---|---|---|
| 41 10 978A | 10/1991 | European Pat. Off. . | |
| 3-208923 | 9/1991 | Japan . | |
| 3-217523 | 9/1991 | Japan . | |
| 3-221628 | 12/1991 | Japan . | |
| 6-146331 | 5/1994 | Japan . | |
| 6-257185 | 9/1994 | Japan . | |
| 6-264475 | 12/1994 | Japan . | |
| 6-313323 | 3/1995 | Japan . | |
| 7-090887 | 8/1995 | Japan . | |
| 7-150594 | 10/1995 | Japan . | |
| 2222997 | 3/1990 | United Kingdom | 701/50 |

*Primary Examiner*—Terry Lee Melius
*Assistant Examiner*—Victor Batson
*Attorney, Agent, or Firm*—Fay, Sharpe, Beall, Fagan, Minnich & McKee

[57] ABSTRACT

A work area limitation control system for a construction machine which includes a second entrance forbidden area calculating portion which sets a second entrance forbidden area positioned closer to a front device than a first entrance forbidden area. A slowdown control calculating portion calculates distances between two monitoring points and the second and first entrance forbidden areas and modifies operation signals (pilot pressures) depending on the relation of the calculated distances with respect to a slowdown distance.

12 Claims, 14 Drawing Sheets

EXTENSION OF BOOM CYLINDER

CONTRACTION OF BOOM CYLINDER

EXTENSION OF ARM CYLINDER

EXTENSION OF ARM CYLINDER

WORK AREA LIMITATION CONTROL SYSTEM FOR CONSTRUCTION MACHINE

BACKGROUND OF THE INVENTION

1. Field of the Invention

The present invention relates to a work area limitation control system for a construction machine having a multi-articulated front device, and more particularly to a work area limitation control system for a hydraulic excavator having a front device made up of multiple front members such as an arm, a boom and a bucket.

2. Description of the Related Art

In a hydraulic excavator, a multi-articulated working device (front device) is constructed by attaching a boom to a front portion of an upper structure and connecting an arm and a bucket to a tip end of the boom tandem in the order named. Such work as digging and loading is carried out by controlling flexion movement of the working device.

Meanwhile, in some job sites of hydraulic excavators, there is an obstacle above or in front of the excavator. An overhead obstacle is, e.g., a mid-air electric wire in outdoor work and the ceiling of a structure in indoor work. When the job site is, e.g., a residential area partitioned into narrow plots, a wall of a private house or the like often exists in front of the excavator, thus posing an obstacle in the front. During work, an operator must pay close attention so that part of a working device, e.g., a bucket prong, will not contact or catch such an obstacle. This imposes a great burden on the operator.

To cope with the above problem, JP-A-3-208923 discloses an invention as follows. In advance, an entrance forbidden area is set at an upper level and an actuator slowdown area is set at a level lower than the entrance forbidden area. When any one of the tip end positions of front members making up a working device which is at the highest level enters the slowdown area, the operating speed of the actuators is reduced to slow down the working device, and further when it reaches the entrance forbidden area, the operation of the actuators is ceased to stop the working device. Any part of the working device is thereby prevented from contacting an overhead obstacle.

Also, JP-A-3-217523 discloses an invention that, to prevent a working device from interfering with a cab, an entrance forbidden area is set in advance and, when a tip end of the working device reaches the entrance forbidden area, the operation of the actuators is ceased to stop the working device.

SUMMARY OF THE INVENTION

However, the foregoing prior art has problems as explained below.

An operator engaged in field work does not like that the operation of all actuators is suddenly stopped or the operating speed thereof is abruptly reduced during the work. The reason is that a sudden stop of the operation or an abrupt reduction in the operating speed of all the actuators would reduce maneuverability and reduce working efficiency. When the foregoing prior art is practiced in work requiring the working device to be moved into the vicinity of the entrance forbidden area, the operation of all the actuators is suddenly stopped when the working device reaches the entrance forbidden area. Therefore, each time it reaches the entrance forbidden area, the working device is completely stopped during the work, which results in a remarkable reduction in maneuverability and working efficiency.

Further, in the case of a slowdown area being set, the operating speed of the actuators is reduced in the vicinity of the entrance forbidden area, which also results in a reduction in maneuverability and working efficiency.

An object of the present invention is to provide a work area limitation control system for a construction machine which can prevent contact between a front device and an obstacle without reducing maneuverability to the extent possible.

To achieve the above object, the present invention is constructed as follows.

(1) The present invention includes a work area limitation control system for a construction machine, the control system being equipped on a construction machine comprising a machine body, a multi-articulated front device made up of a plurality of front members including first and second front members connected to the machine body, a plurality of hydraulic actuators for driving the plurality of front members, a plurality of operating means for instructing operations of the plurality of front members and a plurality of flow control valves driven in accordance with operation signals input from the plurality of operating means for controlling flow rates of a hydraulic fluid supplied to the plurality of hydraulic actuators. The control system operates to cease supply of the hydraulic fluid to the hydraulic actuators to stop the front device when the front device reaches a preset first entrance forbidden area. The control system comprises entrance forbidden area setting means for setting a second entrance forbidden area positioned closer to the front device than the first entrance forbidden area, and first operation signal modifying means for modifying the operation signals input from the operating means for the first and second front members such that immediately before a first monitoring point set on the second front member enters the second entrance forbidden area, the first front member is stopped, but the second front member is allowed to move.

With the feature set forth above, the first operation signal modifying means is provided to modify the operation signals input from the operating means such that when the first monitoring point set on the second front member is going to enter the second entrance forbidden area, the first front member is stopped immediately before the entrance, but the second front member is allowed to move. Therefore, when the first monitoring point reaches the boundary of the second entrance forbidden area, the first front member is stopped, but the second front member is kept freely movable. As a result, any deterioration of maneuverability is suppressed. Further, because of the second entrance forbidden area being set to a position closer to the front device than the first entrance forbidden area, by properly setting a distance between the boundaries of both the entrance forbidden areas, any part of the front device is prevented from entering the first entrance forbidden area even when the second front member is moved after the first front member has stopped and, therefore, contact between the front device and an obstacle is prevented.

(2) In the above (1), preferably, the first operation signal modifying means modifies the operation signal input from the operating means for the first front member such that when the first monitoring point comes close to the second entrance forbidden area, the first front member is slowed down.

By so slowing down the first front member by the first operation signal modifying means, the first front member is smoothly stopped immediately before entering the second entrance forbidden area. It is therefore possible to abate an overshooting of the first front member and a shock produced upon stoppage thereof. Also, while the first front member is brought under the slowdown control, the second front member remains freely movable unless it is per se brought under the slowdown control. As a result, deterioration of maneuverability is greatly suppressed.

(3) In the above (1), preferably, the control system further comprises second operation signal modifying means for modifying the operation signals input from the operating means for the first and second front members such that immediately before a second monitoring point set on the front device enters the first entrance forbidden area, the first and second front members are both stopped.

By so further providing the second operation signal modifying means and stopping both the first and second front members immediately before the second monitoring point enters the first entrance forbidden area, the front device is prevented from entering the first entrance forbidden area.

(4) In the above (3), preferably, the second operation signal modifying means modifies the operation signals input from the operating means for the first and second front members such that when the second monitoring point comes close to the first entrance forbidden area, the first and second front members are both slowed down.

By so slowing down the first and second front members by the second operation signal modifying means, the first and second front member are smoothly stopped immediately before entering the second and first entrance forbidden areas, respectively. It is therefore possible to abate overshootings of the first and second front members and shocks produced upon stoppage thereof.

(5) In the above (1), preferably, the first and second front members are adjacent front members articulated with each other such that the second front member is pivotable relative to the first front member.

(6) In the above (1), by way of example, the first and second front members are a boom and an arm of a hydraulic excavator.

(7) In the above (1), preferably, the entrance forbidden area setting means sets the second entrance forbidden area to be spaced from the first entrance forbidden area by a distance sufficient to prevent any part of the second front member from entering the first entrance forbidden area when the second front member is moved in a condition where the first monitoring point is positioned on a boundary of the second entrance forbidden area.

By so setting the second entrance forbidden area, any part of the front device is prevented from entering the first entrance forbidden area even when the second front member is moved in such a condition.

(8) In the above (1), by way of example, the plurality of operating means are of a hydraulic pilot type outputting pilot pressures as the operation signals, and the first operation signal modifying means includes pilot pressure modifying means for reducing the pilot pressure output from the operating means for the first front member down to a reservoir pressure immediately before the first monitoring point enters the second entrance forbidden area.

(9) Also in the above (2), by way of example, the plurality of operating means are of a hydraulic pilot type outputting pilot pressures as the operation signals, and the second operation signal modifying means includes pilot pressure modifying means for reducing the pilot pressures output from the operating means for the first and second front members down to a reservoir pressure immediately before the second monitoring point enters the first entrance forbidden area.

(10) In the above (8) and (9), preferably, the pilot pressure modifying means includes electric pressure reducing valves disposed in pilot lines for transmitting the pilot pressures output from the operating means for the first and second front members to the associated flow control valves.

DETAILED DESCRIPTION OF THE PREFERRED EMBODIMENTS

A first embodiment of the present invention, which is applied to a hydraulic excavator, will be described below with reference to FIGS. 1 to 10. Note that the first embodiment is adapted for overhead area limitation control.

Figure 1:
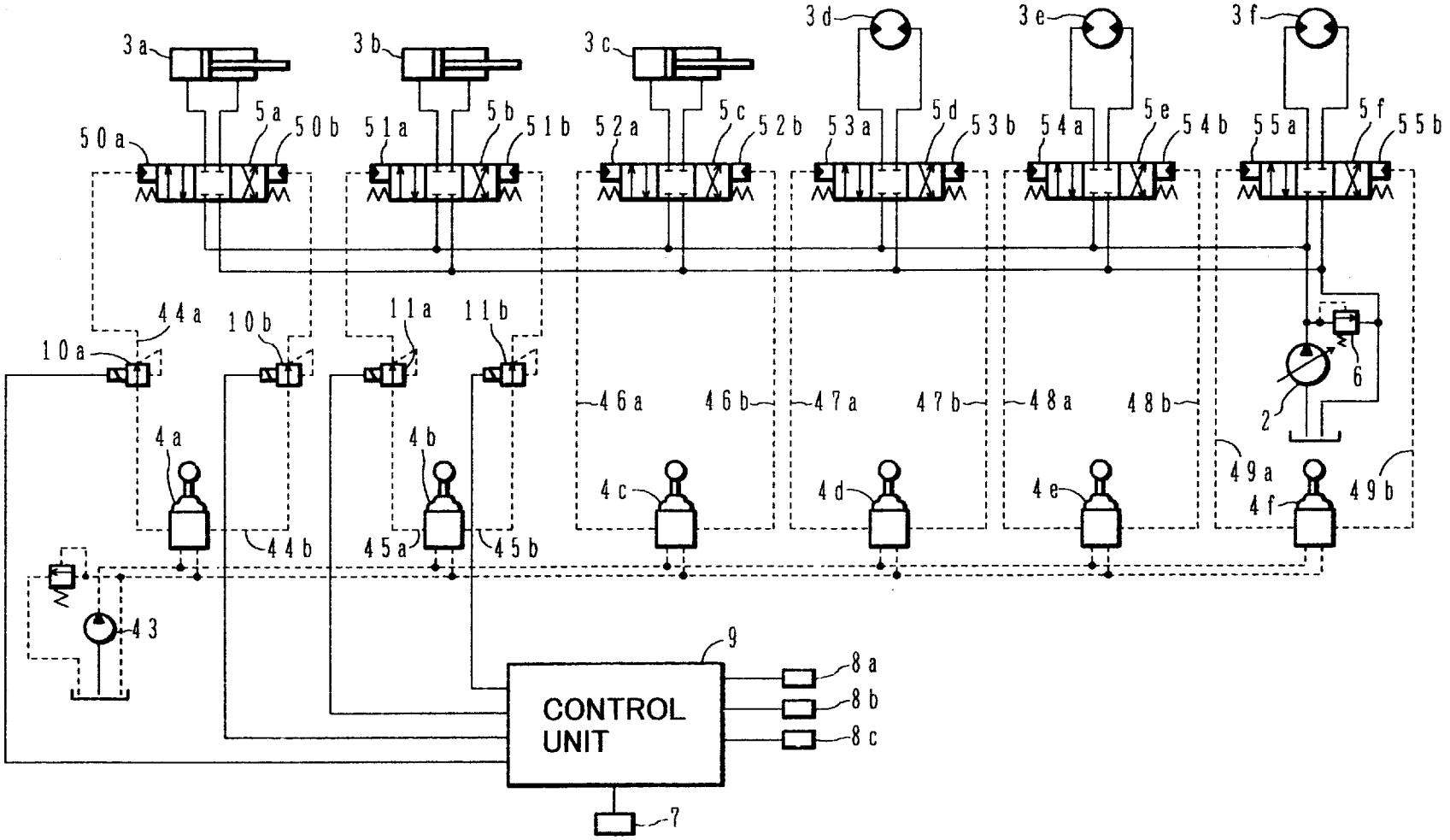
FIG. 1 is a diagram showing a work area limitation control system for a construction machine according to a first embodiment of the present invention, along with a hydraulic drive system thereof.

In FIG. 1, a hydraulic excavator to which the present invention is applied includes a hydraulic drive system comprising a hydraulic pump 2, a plurality of hydraulic actuators driven by a hydraulic fluid supplied from the hydraulic pump 2, including a boom cylinder 3*a*, an arm cylinder 3*b*, a bucket cylinder 3*c*, a swing motor 3*d*, and left and right track motors 3*e*, 3*f*, a plurality of control lever units 4*a*–4*f* associated respectively with the hydraulic actuators 3*a*–3*f*, a plurality of flow control valves 5*a*–5*f* connected between the hydraulic pump 2 and the plurality of hydraulic actuators 3*a*–3*f* and driven in accordance with operation signals input from the control lever units 4*a*–4*f* for controlling flow rates of the hydraulic fluid supplied to the hydraulic actuators 3*a*–3*f*, and a relief valve 6 made open when a pressure between the hydraulic pump 2 and the flow control valves 5*a*–5*f* exceeds a preset value.

Figure 2:
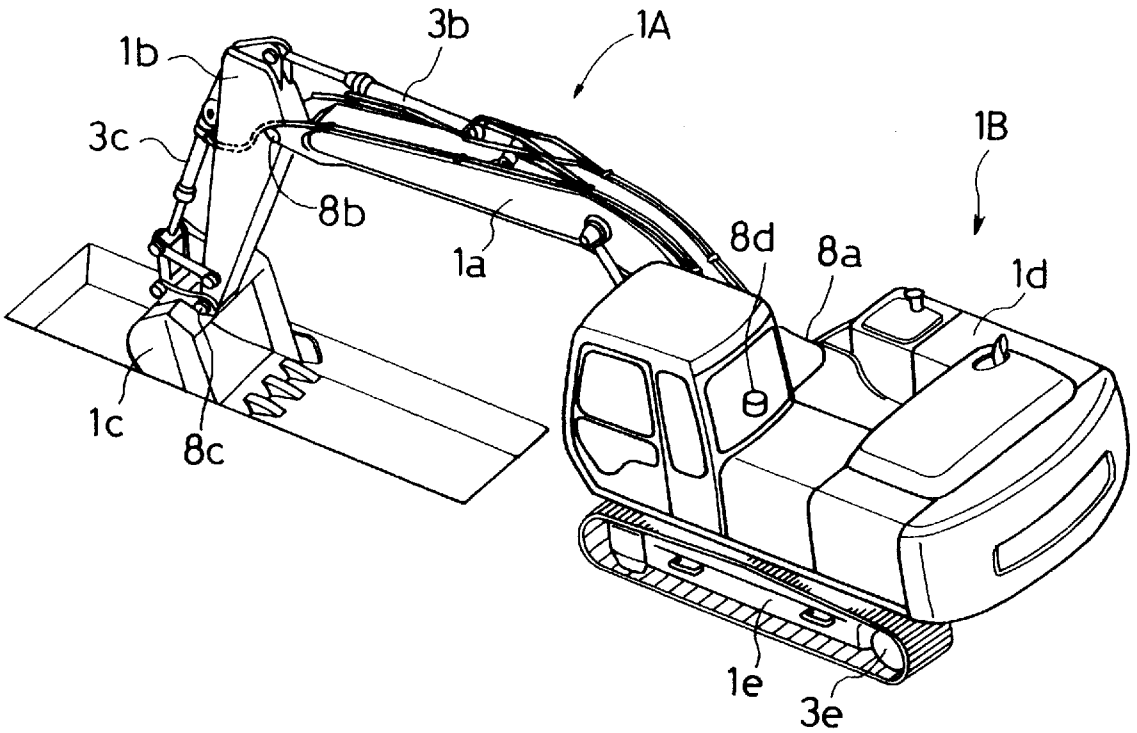
FIG. 2 is a perspective view showing an appearance of a hydraulic excavator to which the first embodiment is applied.

Also, the hydraulic excavator comprises, as shown in FIG. 2, a multi-articulated working device, i.e., a front device 1A, made up of a boom 1*a*, an arm 1*b* and a bucket 1*c* which are each pivotable in the vertical direction, and a vehicle (machine) body 1B consisted of an upper structure 1*d* and an undercarriage 1*e*. The boom 1*a* of the front device 1A is supported at its base end to a front portion of the upper structure 1*d*. The boom 1*a*, the arm 1*b*, the bucket 1*c*, the upper structure 1*d* and the undercarriage 1*e* are driven respectively by the boom cylinder 3*a*, the arm cylinder 3*b*, the bucket cylinder 3*c*, the swing motor 3*d*, and the left and right track motors 3*e*, 3*f*.

Figure 3:
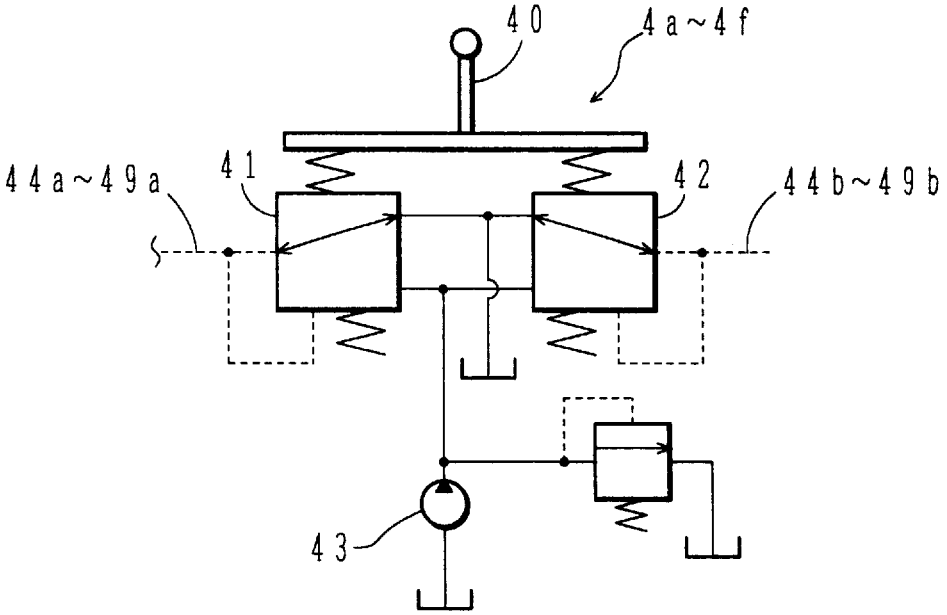
FIG. 3 is a diagram showing details of a control lever unit of a hydraulic pilot type.

The control lever units 4*a*–4*f* are of a hydraulic pilot type and produce respective pilot pressures to drive the associated flow control valves 5*a*–5*f*. As shown in FIG. 3, the control lever units 4*a*–4*f* each comprise a control lever 40 operated by an operator, and a pair of pressure reducing valves 41, 42 producing a pilot pressure depending on the amount and the direction by and in which the control lever 40 is operated. The pairs of pressure reducing valves 41, 42 have primary ports connected to a pilot pump 43 and secondary ports connected to hydraulic driving sectors 50*a*, 50*b*; 51*a*, 51*b*; 52*a*, 52*b*; 53*a*, 53*b*; 54*a*, 54*b*; 55*a*, 55*b* of the associated flow control valves through respective pilot lines 44*a*, 44*b*; 45*a*, 45*b*; 46*a*, 46*b*; 47*a*, 47*b*; 48*a*, 48*b*; 49*a*, 49*b*.

A work area limitation control system of this embodiment is equipped on the hydraulic excavator constructed as described above. The limitation control system comprises a setting device 7 for instructing setting of an area where the front device 1A should not enter (hereinafter referred to as a first entrance forbidden area) in advance depending on the type of work to be performed, angle sensors 8*a*, 8*b*, 8*c* disposed at respective pivot points, i.e., articulated joints, of the boom 1*a*, the arm 1*b* and the bucket 1*c* for detecting respective rotational angles as status variables in relation to the position and attitude of the front device 1A, a control unit 9 for receiving a setting signal from the setting device 7 and detection signals from the angle sensors 8*a*, 8*b*, 8*c* and then outputting electric signals as command signals for limiting a work area of the front device 1A, and proportional solenoid valves 10*a*, 10*b*, 11*a*, 11*b* driven by the electric signals output from the control unit 9. The proportional solenoid valves 10*a*, 10*b*, 11*a*, 11*b* are disposed respectively in the pilot lines 44*a*, 44*b*, 45*a*, 45*b* and reduce the pilot pressures produced by the associated control lever units 4*a*, 4*b* in accordance with the respective electric signals input thereto, followed by outputting the reduced pilot pressures.

The setting device 7 is to output, to the control unit 9, a setting signal for instructing setting of an entrance forbidden area through input means, such as a switch, provided on a control panel or a grip. The control panel may also include thereon other aid means such as a display. Alternatively, a setting signal may be applied to the control unit 9 in any other suitable manner such as using IC cards, bar codes, lasers or wireless communication.

Figure 4:
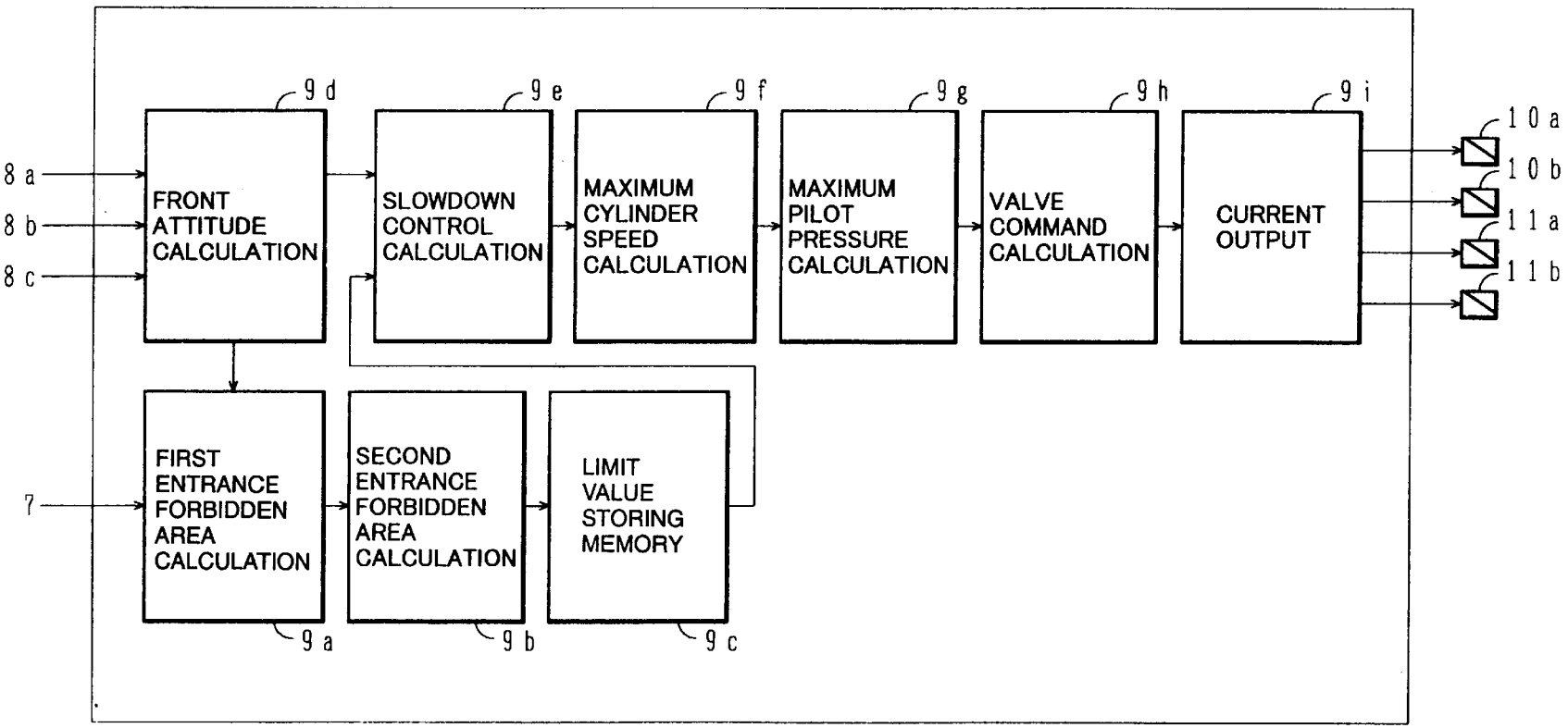
FIG. 4 is a functional block diagram showing control functions of a control unit according to the first embodiment.

Control functions of the control unit 9 are shown in FIG. 4. The control unit 9 has functions executed by a first entrance forbidden area calculating portion 9*a*, a second entrance forbidden area calculating portion 9*b*, a limit value storing memory portion 9*c*, a front attitude calculating portion 9*d*, a slowdown control calculating portion 9*e*, a maximum cylinder speed calculating portion 9*f*, a maximum pilot pressure calculating portion 9*g*, a valve command calculating portion 9*h*, and a current output portion 9*i*.

The first entrance forbidden area calculating portion 9*a* sets and calculates, in response to the instruction from the setting device 7, the first entrance forbidden area where the front device 1A should not enter. One example of this function will be described with reference to FIG. 5.

Figure 5:
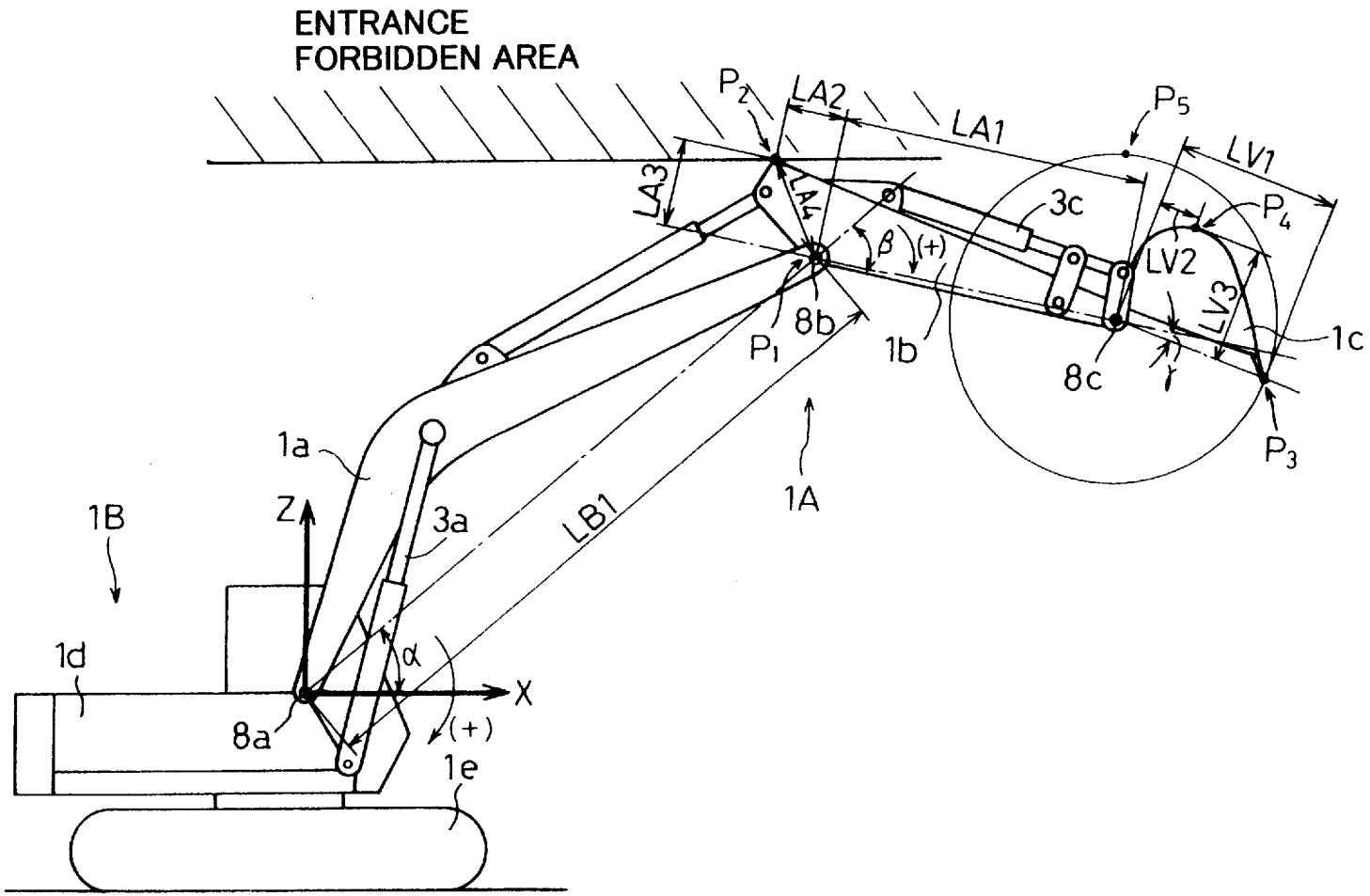
FIG. 5 is a view for explaining a method of setting a coordinate system and an area for use in the work area limitation control system of the first embodiment.
Figure 6:
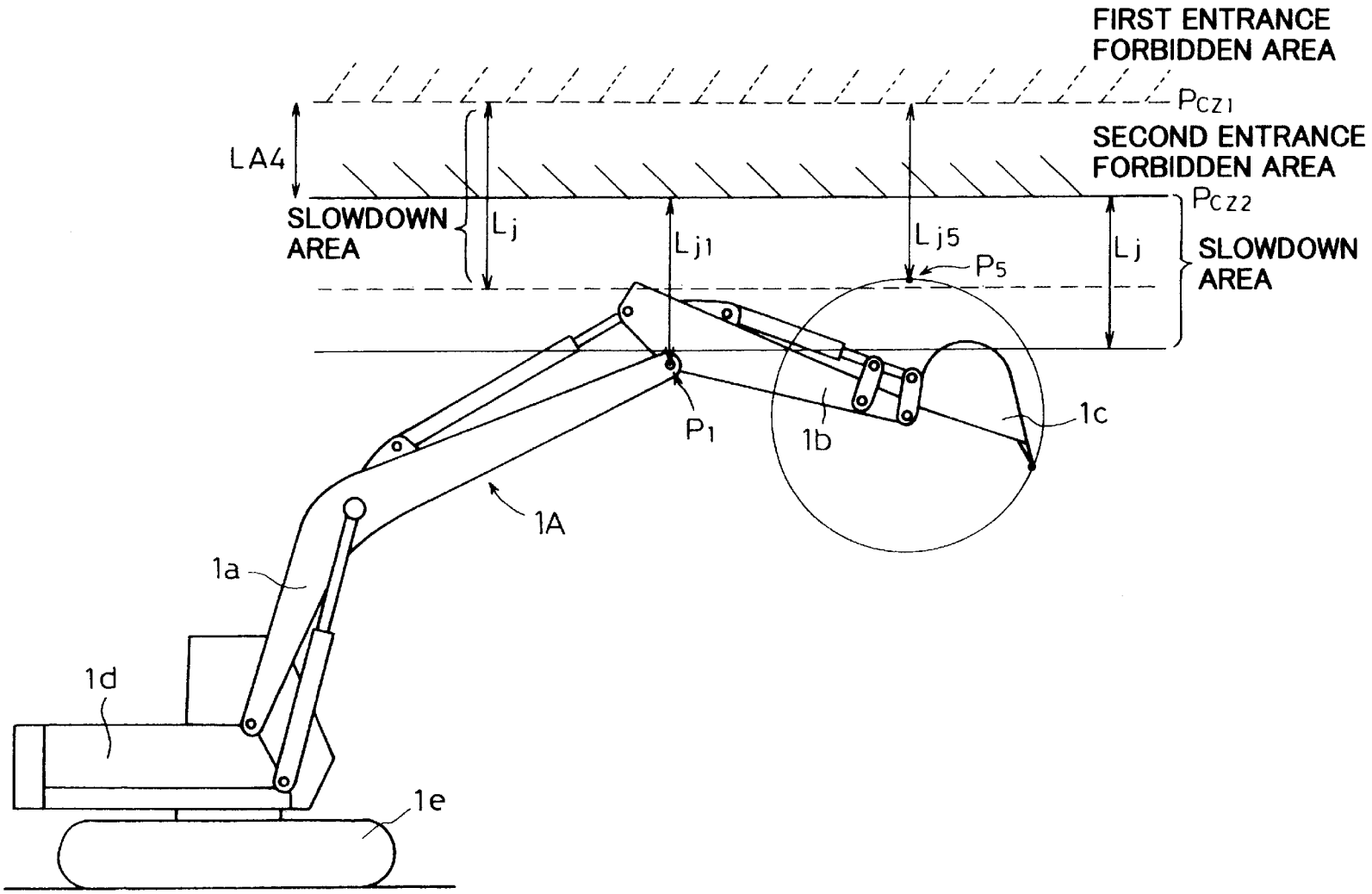
FIG. 6 is a view showing first and second entrance forbidden areas and corresponding slowdown areas for use in the work area limitation control system of the first embodiment.

In FIG. 5, a plurality of monitoring points P1–P5 are set on the front device 1A at predetermined positions beforehand. The operator starts operation to move up the front device 1A to a height at which an overhead limit is to be set. Under this condition, in response to the instruction from the setting device 7, respective heights P1z–P5z of the monitoring points P1–P5 are calculated and a maximum one of the calculated values is set as a boundary value ($P_{cz1}$) of the first entrance forbidden area. In the illustrated example, the monitoring point P2 set at a rear end of the arm 1*b* is at the highest level and, therefore, the height P2z of the monitoring point P2 is set as a boundary value ($P_{cz1}$) of the first entrance forbidden area. Note that the values of P1z to P5z are calculated in the front attitude calculating portion 9*d*.

The second entrance forbidden area calculating portion 9*b* calculates a boundary value ($P_{cz2}$) of a second entrance forbidden area from the boundary value ($P_{cz1}$) of the first entrance forbidden area calculated by the first entrance forbidden area calculating portion 9*a*. The calculation formula used here is below;

$$P_{cz2}=P_{cz1}-LA4$$

where LA4 is a distance from the monitoring point P1 to the monitoring point P2 set at the rear end of the arm 1*b*. The monitoring point P1 is set at the pivot point between the boom 1*a* and the arm 1*b*.

The limit value storing memory portion 9*c* stores the boundary values $P_{cz1}$, $P_{cz2}$ calculated by the first and second entrance forbidden area calculating portions 9*a*, 9*b*.

The front attitude calculating portion 9*d* calculates a position and attitude of the front device 1A based on the rotational angles of the boom, the arm and the bucket detected by the angle sensors 8*a*–8*c* and other such data as respective dimensions LA1, LA2, LA3, LA4, LB1, LV1, LV2, LV3 of the front device 1A and the vehicle body 1B, shown in FIG. 5, which are stored in a storage of the control unit 9 beforehand. At this time, the position and attitude of the front device 1A are determined as coordinate values of an XZ-coordinate system with the pivot point of the boom 1*a*, for example, being at the origin. The XZ-coordinate system is a rectangular coordinate system fixed on the vehicle body 1B and lying in a vertical plane.

In the setting process of the first entrance forbidden area by the calculating portion 9*a*, the front attitude calculating portion 9*d* calculates respective values of the monitoring points P1–P5 as Z-coordinate values in the XZ-coordinate system, and sets a maximum one of the calculated values as the boundary value (Z-coordinate value=$P_{cz1}$) of the first entrance forbidden area.

Further, during the operation of the hydraulic excavator, the front attitude calculating portion 9*d* continues to calculate respective positions of the monitoring points P1–P5. This embodiment uses the two monitoring points P1, P5 in calculation for overhead limit control. The monitoring point P1 is set at the pivot point between the boom 1*a* and the arm 1*b*, as mentioned above, and the monitoring point P5 is set at the highest point on a circle having a radius LV1 (distance from a bucket pin to a bucket tip end) about the pivot center (bucket pin) of the bucket 1*c*.

The Z-coordinate values of the monitoring points P1–P5 calculated by the front attitude calculating portion 9*d* are determined based on rotational angles α, β, γ and the respective dimensions shown in FIG. 5, which are stored in the storage, by using formulae below;

$$P_{1z}=-LB1\sin\alpha$$

$$P_{2z}=LA2\sin(\alpha+\beta)+LA3\cos(\alpha+\beta)-LB1\sin\alpha$$

$$P_{3z}=-LV1\sin(\alpha+\beta+\gamma)-LA1\sin(\alpha+\beta)-LB1\sin\alpha$$

$$P_{4z}=-LV2\sin(\alpha+\beta+\gamma)+LA3\cos(\alpha+\beta+\gamma)-LA1\sin(\alpha+\beta)-LB1\sin\alpha$$

$$P_{5z}=-LA1\sin(\alpha+\beta)-LB1\sin\alpha+LV1$$

where α, β, γ are positive in the clockwise direction as indicated by arrow in FIG. 5.

The slowdown control calculating portion 9*e* calculates slowdown command signals $K_{BU}$, $K_{BD}$ for the boom cylinder 3*a* in the extending and contracting directions thereof and $K_{AC}$, $K_{AD}$ for the arm cylinder 3*b* in the extending and contracting directions thereof based on the Z-coordinate values P1z, P5z of the monitoring points P1, P5 calculated by the front attitude calculating portion 9*d*, the boundary values $P_{cz1}$, $P_{cz2}$ of the first and second entrance forbidden areas stored in the limit value storing memory portion 9*c*, a distance (hereinafter referred to as a slowdown distance) Lj indicating the extent of a slowdown area, and a slowdown function (described later), the slowdown distance Lj and the slowdown function being both stored in the storage of the control unit 9. This calculation process will be described below in more detail with reference to FIG. 6.

First, the calculating portion 9*e* calculates a distance Lj1 between the monitoring point P1 and the second entrance forbidden area, and a distance Lj5 between the monitoring point P5 and the first entrance forbidden area. Then, the slowdown command signals are determined as follows.

(1) If the distances Lj1, Lj5 are both not less than the slowdown distance Lj (i.e., Lj1≧Lj and Lj5≧Lj), the slowdown command signals $K_{BU}$, $K_{BD}$, $K_{AC}$, $K_{AD}$ are all set to one (1). Thus:

$$K_{BU}=1$$

$$K_{BD}=1$$

$$K_{AC}=1$$

$$K_{AD}=1$$

(2) If Lj1<Lj and Lj5≧Lj, $K_{BU}$, $K_{BD}$, $K_{AC}$ and $K_{AD}$ are determined with the following formulae:

$$K_{BU}=Lj1/Lj$$

$$K_{BD}=1$$

$$K_{AC}=1$$

$$K_{AD}=1$$

(3) If Lj1≧Lj and Lj5<Lj, $K_{BU}$, $K_{BD}$, $K_{AC}$ and $K_{AD}$ are determined with the following formulae:

$$K_{BU}=Lj5/Lj$$

$$K_{BD}=1$$

$$K_{AC}=1$$

$$K_{AD}=Lj5/Lj$$

(4) If Lj1<Lj and Lj5<Lj, $K_{BU}$, $K_{BD}$, $K_{AC}$ and $K_{AD}$ are determined with the following formulae:

$$K_{BU}=min(Lj1/Lj5)/Lj$$

$$K_{BD}=1$$

$$K_{AC}=1$$

$$K_{AD}=Lj5/Lj$$

Figure 7A:
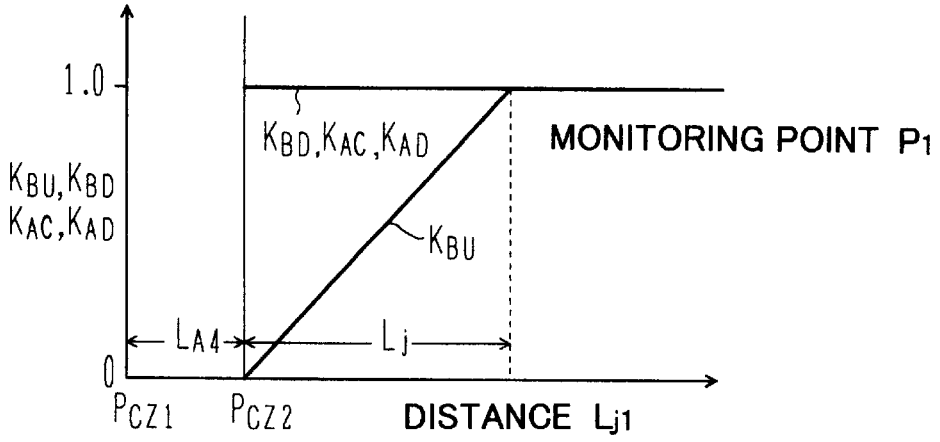
FIGS. 7A, 7B and 7C are graphs showing the relationship between a distance from a monitoring point to the entrance forbidden area and a slowdown command signal in a slowdown control calculating portion.
Figure 7B:
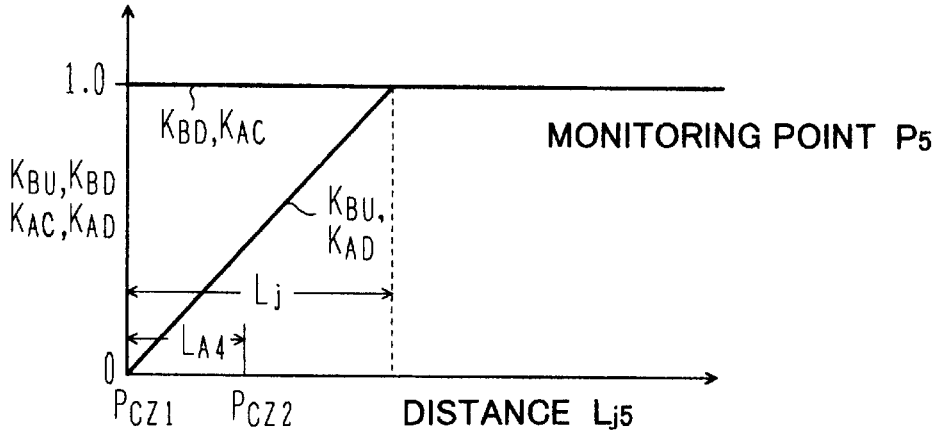
Figure 7C:
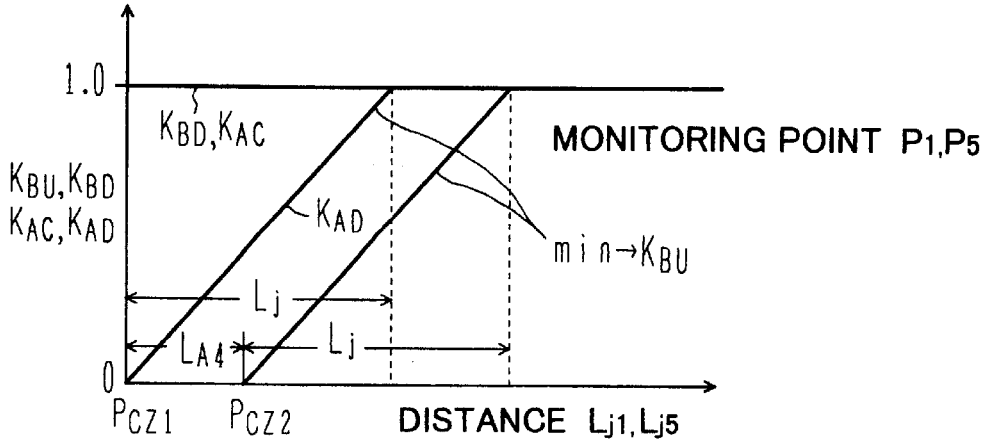
Figure 8A:
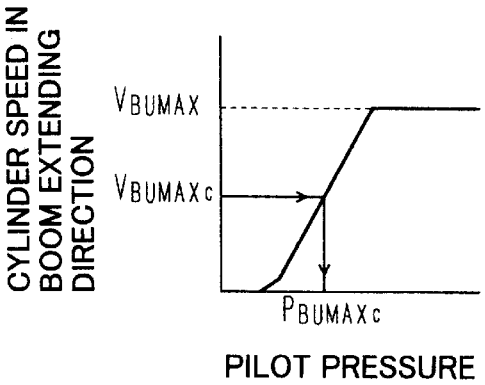
FIGS. 8A, 8B, 8C and 8D are graphs showing the relationship between a pilot pressure and a cylinder speed in a maximum pilot pressure calculating portion.
Figure 8B:
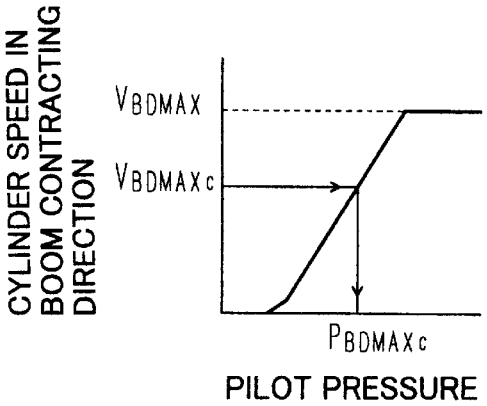
Figure 8C:
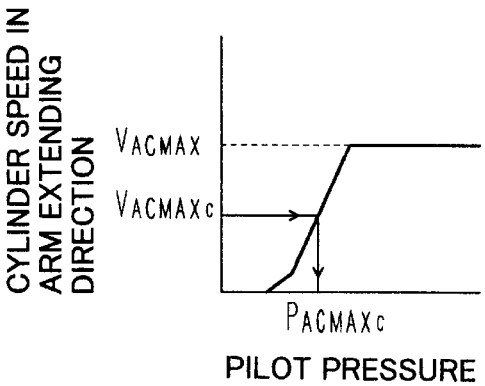
Figure 8D:
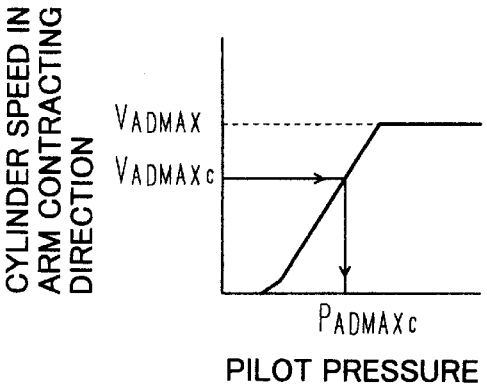

The above formulae are represented in the graphic form in FIGS. 7A–7C. In the graphs of FIGS. 7A–7C, FIG. 7A represents the case of (2) above, FIG. 7B represents the case of (3) above, and FIG. 7C represents the case of (4) above, respectively. In the case of (2) above, as shown in FIG. 7A, the slowdown command signal $K_{BU}$ is linearly reduced from 1 as the distance Lj1 reduces within the extent of the slowdown distance Lj, and then becomes nil (0) at the distance Lj1=$P_{cz2}$, i.e., when the monitoring point P1 reaches the boundary $P_{cz2}$ of the second entrance forbidden area. Stated otherwise, when the monitoring point P1 enters the slowdown area, the operation of the boom cylinder 3*a* in the extending direction (boom-up operation) is slowed down, and when the monitoring point P1 reaches the boundary $P_{cz2}$ of the second entrance forbidden area, the boom-up operation is stopped. The other slowdown command signals $K_{BD}$, $K_{AC}$, $K_{AD}$ remain 1 so that the arm 1*b* is kept freely movable.

In the case of (3) above, as shown in FIG. 7B, the slowdown command signals $K_{BU}$, $K_{AD}$ are linearly reduced from 1 as the distance Lj5 reduces within the extent of the slowdown distance Lj, and then becomes 0 at the distance Lj5=$P_{cz1}$, i.e., when the monitoring point P5 reaches the boundary $P_{cz1}$ of the first entrance forbidden area. Stated otherwise, when the monitoring point P5 enters the slowdown area, the operation of the boom cylinder 3*a* in the extending direction (boom-up operation) and the operation of the arm cylinder 3*b* in the contracting direction (arm dumping operation) are both slowed down, and when the monitoring point P5 reaches the boundary $P_{cz1}$ of the first entrance forbidden area, the boom-up operation and the arm dumping operation are both stopped.

In the case of (4) above, as shown in FIG. 7C, the slowdown command signal $K_{BU}$ is given by a smaller value of the slowdown command signals calculated in the above two cases (2) and (3), and the slowdown command signal $K_{AD}$ is given by the same value as calculated in the above case (3). Stated otherwise, after the monitoring point P1 has reached the boundary $P_{cz2}$ of the second entrance forbidden area, the slowdown command signal $K_{BU}$ is kept at 0 so that the boom 1*a* will not move up above a level of the boundary $P_{cz2}$ of the second entrance forbidden area, whereas only the operation of the arm cylinder 3*b* in the contracting direction (arm dumping operation) is slowed down.

The maximum cylinder speed calculating portion 9*f* calculates maximum cylinder speeds $V_{BU}max_C$, $V_{BD}max_C$ of the boom extending and contracting operations during slowdown and maximum cylinder speeds $V_{AC}max_C$, $V_{AD}max_C$ of the arm extending and contracting operations during slowdown based on maximum cylinder speeds $V_{BU}max$, $V_{BD}max$ in the boom extending and contracting directions and maximum cylinder speeds $V_{AC}max$, $V_{AD}max$ in the arm extending and contracting directions which are stored in the control unit 9 beforehand, as well as the above slowdown command signals $K_{BU}$, $K_{BD}$, $K_{AC}$, $K_{AD}$. The calculation formulae used here are set forth below:

$$V_{BU}max_C=K_{BU}\times V_{BU}max$$

$$V_{BD}max_C=K_{BD}\times V_{BD}max$$

$$V_{AC}max_C=K_{AC}\times V_{AC}max$$

$$V_{AD}max_C=K_{AD}\times V_{AD}max$$

The maximum pilot pressure calculating portion 9*g* calculates maximum load pressures $P_{BU}max_C$, $P_{BD}max_C$ for the boom extending and contracting operations during slowdown and maximum load pressures $P_{AC}max_C$, $P_{AD}max_C$ for the arm extending and contracting operations during slowdown based on $V_{BU}max_C$, $V_{BD}max_C$, $V_{AC}max_C$, $V_{AD}max_C$ calculated by the maximum cylinder speed calculating portion 9*f* and tables indicating the relationships between pilot pressures and cylinder speeds, as shown in FIGS. 8A–8D, which are stored in the control unit 9 beforehand.

Figure 9:
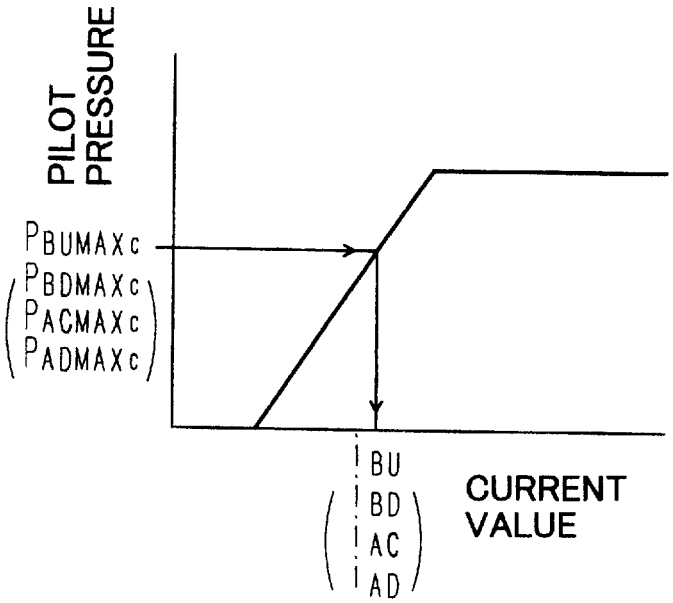
FIG. 9 is a graph showing the relationship between a pilot pressure and a current value output to an electric pressure reducing valve in a valve command calculating portion.

The valve command calculating portion 9*h* calculates electric signals $i_{BU}$, $i_{BD}$, $i_{AC}$, $i_{AD}$ for the electric pressure reducing valves 10*a*, 10*b*, 11*a*, 11*b* for restricting speeds of the boom extending and contracting operations and the arm extending and contracting operations based on $P_{BU}max_C$, $P_{BD}max_C$, $P_{AC}max_C$, $P_{AD}max_C$ calculated by the maximum pilot pressure calculating portion 9*g* and tables indicating the relationship between a pilot pressure and a current value, as shown in FIG. 9, which is stored in the control unit 9 beforehand.

The current output portion 9*i* outputs current values corresponding to $i_{BU}$, $i_{BD}$, $i_{AC}$, $i_{AD}$ to the electric pressure reducing valves 10*a*, 10*b*, 11*a*, 11*b*, respectively.

Here, the maximum pilot pressures $P_{BU}max_C$, $P_{BD}max_C$, $P_{AC}max_C$, $P_{AD}max_C$ during slowdown are calculated by the maximum pilot pressure calculating portion 9*g* when the slowdown command signals calculated by the slowdown control calculating portion 9*e* are $K_{BU}=1$, $K_{BD}=1$, $K_{AC}=1$ and $K_{AD}=1$, are set to maximum pilot pressures (rated pilot pump pressures) and the command electric values $i_{BU}$, $i_{BD}$, $i_{AC}$, $i_{AD}$ calculated at this time are meant to fully open the electric pressure reducing valves 10*a*, 10*b*, 11*a*, 11*b*. Also, when $K_{BU}=0$, $K_{BD}=0$, $K_{AC}=0$ and $K_{AD}=0$ hold, the maximum pilot pressures $P_{BU}max_C$, $P_{BD}max_C$, $P_{AC}max_C$, $P_{AD}max_C$, during slowdown are made 0 and the command electric values $i_{BU}$, $i_{BD}$, $i_{AC}$, $i_{AD}$ calculated at this time are meant to fully close the electric pressure reducing valves 10*a*, 10*b*, 11*a*, 11*b*.

Figure 10:
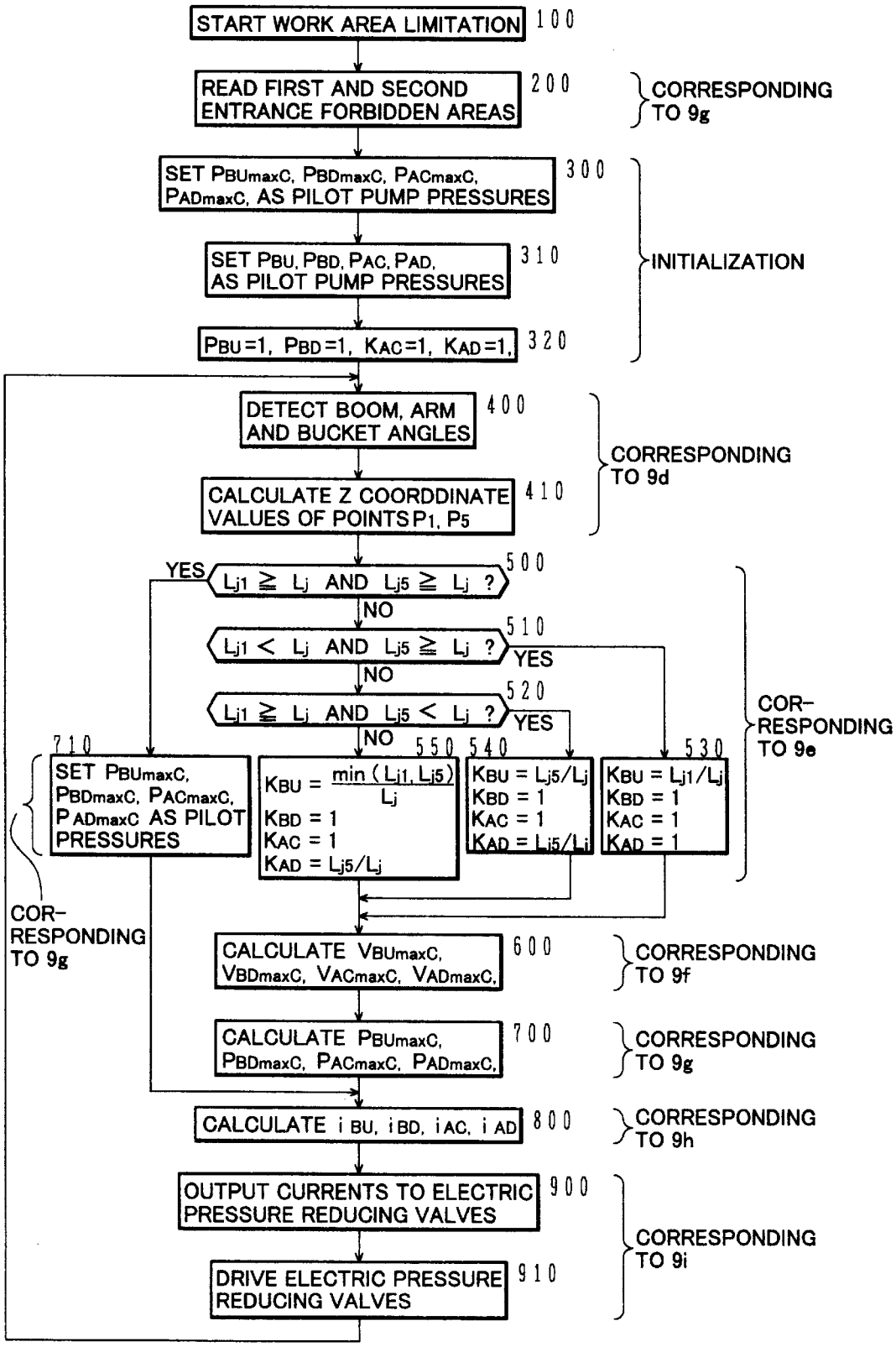
FIG. 10 is a flowchart showing processing procedures of the control unit.

The flow of the foregoing control process is shown in a flowchart of FIG. 10.

In FIG. 10, steps 400, 410 correspond to the front attitude calculating portion 9*d*, steps 200, 500–550 correspond to the slowdown control calculating portion 9*e*, step 600 corresponds to the maximum cylinder speed calculating portion 9*f*, steps 700, 710 correspond to the maximum pilot pressure calculating portion 9*g*, step 800 corresponds to the valve command calculating portion 9*h*, and steps 900, 910 correspond to the current output portion 9*i*. Furthermore, steps 300–320 represent initialization for the sake of safety.

In the above arrangement, supposing that the boom 1*a* is a first front member and the arm 1*b* is a second front member, the control lever units 4*a*–4*f* constitute a plurality of operating means for instructing the operation of a plurality of front members, the monitoring point P1 corresponds to a first monitoring point set on the second front member, and the second entrance forbidden area calculating portion 9*b* and the limit value storing memory portion 9*c* in the control unit 9 cooperatively constitute entrance forbidden area setting means for setting the second entrance forbidden area positioned closer to the front device 1A than the first entrance forbidden area. Also, the angle sensors 8*a*, 8*b*, 8*c*, the proportional solenoid valves 10*a*, 10*b*, 11*a*, 11*b*, the front attitude calculating portion 9*d*, the slowdown control calculating portion 9*e*, the maximum cylinder speed calculating portion 9*f*, the maximum pilot pressure calculating portion 9*g*, the valve command calculating portion 9*h*, and the current output portion 9*i*, these portions being in the control unit 9, cooperatively constitute first operation signal modifying means for modifying the operation signals input from the operating means for the first and second front members such that immediately before the first monitoring point set on the second front member enters the second entrance forbidden area, the first front member is stopped, but the second front member is kept allowed to move. Further, as seen from the above description, the first operation signal modifying means also modifies the operation signal input from the operating means for the first front member such that the first front member is slowed down as the first monitoring point comes closer to the second entrance forbidden area.

The monitoring point P5 corresponds to a second monitoring point set on the front device 1A, and the angle sensors 8*a*, 8*b*, 8*c*, the proportional solenoid valves 10*a*, 10*b*, 11*a*,11*b*, and the front attitude calculating portion 9*d*, the slowdown control calculating portion 9*e*, the maximum cylinder speed calculating portion 9*f*, the maximum pilot pressure calculating portion 9*g*, the valve command calculating portion 9*h*, and the current output portion 9*i*, these portions being in the control unit 9, cooperatively constitute second operation signal modifying means for modifying the operation signals input from the operating means for the first an d second front members such that immediately before the second monitoring point set on the front device 1A enters the first entrance forbidden area, the first and second front members are both stopped. Further, as seen from the above description, the second operation signal modifying means also modifies the operation signals input from the operating means for the first and second front members such that the first and second front members are both slowed down as the second monitoring point comes closer to the first entrance forbidden area.

In addition, the distance LA4 (i.e., the distance from the monitoring point P1 to the monitoring point P2 set at the rear end of the arm 1*b*), which is subtracted from the boundary $P_{cz1}$ of the first entrance forbidden area when the boundary $P_{cz2}$ of the second entrance forbidden area is calculated by the second entrance forbidden area calculating portion 9*b*, is a distance sufficient to prevent any part of the second front member from entering the first entrance forbidden area when the second front member is moved in a condition where the first monitoring point is positioned on the boundary of the second entrance forbidden area. The aforesaid entrance forbidden area setting means sets the second entrance forbidden area at a level spaced from the first entrance forbidden area by that distance.

The operation of this embodiment thus constructed will now be described below.

When the operator manipulates the control lever units 4*a*, 4*b* for the boom and the arm in the boom-up direction and in the arm dumping direction, respectively, with an intention of moving the front device 1A upward, pilot pressures are produced in the pilot line 44*a* on the boom-up side and the pilot line 45*b* on the arm dumping side, whereupon the flow control valves 5*a*, 5*b* are driven to move the corresponding front members, i.e., the boom 1*a* and the arm 1*b*. Rotational angles of the boom 1*a*, the arm 1*b* and the bucket 1*c* articulated with each other are detected respectively by the angle sensors 8*a*–8*c* and detection signals are input to the front attitude calculating portion 9*d*. Based on these input signals, the front attitude calculating portion 9*d* calculates positions of the monitoring points P1–P5, and the slowdown control calculating portion 9*e* calculates a distance Lj1 between the monitoring point p1 and the boundary $P_{cz2}$ of the second entrance forbidden area and a distance Lj5 between the monitoring point p5 and the boundary $P_{cz1}$ of the first entrance forbidden area based on the Z-coordinate values P1z, P5z of the monitoring points P1, P5 calculated by the front attitude calculating portion 9*d* and the boundary values $P_{cz1}$, $P_{cz2}$ of the first and second entrance forbidden areas stored in the limit value storing memory portion 9*c*, and then compares the calculated distances Lj1, Lj5 with the slowdown distance Lj to determine whether or not the monitoring points P1, P5 are in the respective slowdown areas.

When the front device 1A is not so raised and the monitoring points P1, P5 are far away from the first and second entrance forbidden areas, the slowdown control calculating portion 9*e* determines, because of Lj1≧Lj and Lj5≧Lj, that the monitoring points P1, P5 are both not in the respective slowdown areas, and produces slowdown command signals of $K_{BU}$=1, $K_{BD}$=1, $K_{AC}$=1 and $K_{AD}$=1. Therefore, the proportional solenoid valves 10*a*, 10*b*, 11*a*, 11*b* are fully opened and the pilot pressures produced by the control lever units 4*a*, 4*b* are transmitted, as they are, to the flow control valve 5*a* for the boom and the flow control valve 5*b* for the arm, enabling the front device 1A to be moved as manipulated by the operator.

When the front device 1A is so raised that one of the monitoring points P1, P5, e.g., the monitoring point P1, reaches the slowdown area, the slowdown control calculating portion 9*e* determines, because of Lj1<Lj and Lj5≧Lj, that the monitoring point P1 has entered the slowdown area, and calculates slowdown command signals of $K_{BU}$<1, $K_{BD}$=1, $K_{AC}$=1 and $K_{AD}$=1 from the formulae shown in the above case (2) (i.e., the relationship shown in FIG. 7A depending on the distance Lj. Therefore, the operation of the boom cylinder 3*a* in the extending direction, i.e., the boom-up operation, is slowed down, while the arm 1*b* can be moved freely as manipulated by the operator.

When the front device 1A is further raised and the monitoring point P1 reaches the second entrance forbidden area, the slowdown control calculating portion 9*e* calculates the slowdown command signal $K_{BU}$ to be 0 because of Lj1=$P_{cz2}$ whereby the boom-up operation is stopped. At this time, if the monitoring point P5 does not yet reach the slowdown area, the slowdown command signals $K_{BD}$, $K_{AC}$ and $K_{AD}$ remain kept at 1, allowing the arm 1*b* to be moved freely. If the monitoring point P5 is in the slowdown area, the slowdown command signals $K_{BU}$<1, $K_{BD}$=1, $K_{AC}$=1 and $K_{AD}$<1 are calculated (as described below), whereby the arm 1*b* is slowed down, but not stopped. Since the second entrance forbidden area is spaced from the first entrance forbidden area by the distance LA4, no part of the arm 1*b* will not enter the first entrance forbidden area even when the arm 1*b* is moved after the boom-up operation has been stopped.

Returning to the foregoing case, when the other, i.e., P5, of the monitoring points P1, P5 reaches the slowdown area, the slowdown control calculating portion 9*e* determines, because of Lj1≧Lj and Lj5<Lj, that the monitoring point P5 has entered the slowdown area, and calculates slowdown command signals of $K_{BU}$<1, $K_{BD}$=1, $K_{AC}$=1 and $K_{AD}$<1 from the formulae shown in the above case (3) (i.e., the relationship shown in FIG. 7B depending on the distance Lj. Therefore, the operation of the boom cylinder 3*a* in the extending direction, i.e., the boom-up operation, and the operation of the arm cylinder 3*b* in the contracting direction, i.e., the arm dumping operation, are both slowed down.

Further, when both the monitoring points P1, P5 are in the slowdown area, the slowdown control calculating portion 9*e* determines, because of Lj1<Lj and Lj5<Lj, that both the monitoring points P1, P5 have entered the slowdown area, and calculates slowdown command signals of $K_{BU}$<1, $K_{BD}$=1, $K_{AC}$=1 and $K_{AD}$<1 from the formulae shown in the above case (4) (i.e., the relationship shown in FIG. 7C depending on the distance Lj. Therefore, the operation of the boom cylinder 3*a* in the extending direction, i.e., the boom-up operation, and the operation of the arm cylinder 3*b* in the contracting direction, i.e., the arm dumping operation, are both slowed down. In this case, since the slowdown command signal $K_{BU}$ is provided by the smaller one of the slowdown command signals calculated in the above cases (2) and (3), the slowdown command signal $K_{BU}$ becomes 0 and the boom 3*a* is prevented from moving up beyond a level of the boundary $P_{cz2}$ of the second entrance forbidden area after the monitoring point P1 has reached the boundary $P_{cz2}$ of the second entrance forbidden area.

When only the arm 1*b* is further raised and the monitoring point P5 reaches the first entrance forbidden area, the slowdown control calculating portion 9*e* calculates the slowdown command signal $K_{AD}$ to be also 0 because of Lj5=$P_{cz1}$. Therefore, the operation of the arm cylinder 3*b* in the contracting direction, i.e., the arm dumping operation, is also stopped and hence the front device A is completely stopped.

With this embodiment, as described above, when the monitoring point P1 reaches the boundary of the second entrance forbidden area, the boom 1*a* is stopped but the arm 1*b* is not stopped. As a result, a deterioration of maneuverability can be significantly suppressed.

Also, when the monitoring point P1 enters the slowdown area, the boom 1*a* is slowed down, but the arm 1*b* remains freely movable unless the monitoring point P5 enters the slowdown area. This also contributes to suppressing a deterioration of maneuverability.

Further, since the second entrance forbidden area is set to a position closer to the front device than the first entrance forbidden area by the distance LA4, the rear end of the arm 1*b* (i.e., any part of the front device 1A) will not enter the first entrance forbidden area even when the arm 1*b* is moved after the boom 1*a* has stopped and, therefore, the front device 1A is prevented from contacting an obstacle.

Moreover, when the monitoring points P1, P5 enter the slowdown areas, the boom 1*a* and the arm 1*b* are gradually slowed down and then smoothly stopped immediately before the second entrance forbidden area and the first entrance forbidden area, respectively. As a result, it is possible to abate overshootings of the boom 1*a* and the arm 1*b* and shocks produced upon stoppage thereof.

Additionally, since the boom 1*a* and the arm 1*b* are both stopped immediately before the monitoring point P5 enters the first entrance forbidden area, the front device 1A is completely stopped there and will not enter the first entrance forbidden area.

A second embodiment of the present invention will be described with reference to FIGS. 11 to 14. This second embodiment is also adapted for overhead area limitation control. In FIGS. 11 to 14, equivalent members and components to those in the above-referred drawings are denoted by the same reference numerals.

Figure 11:
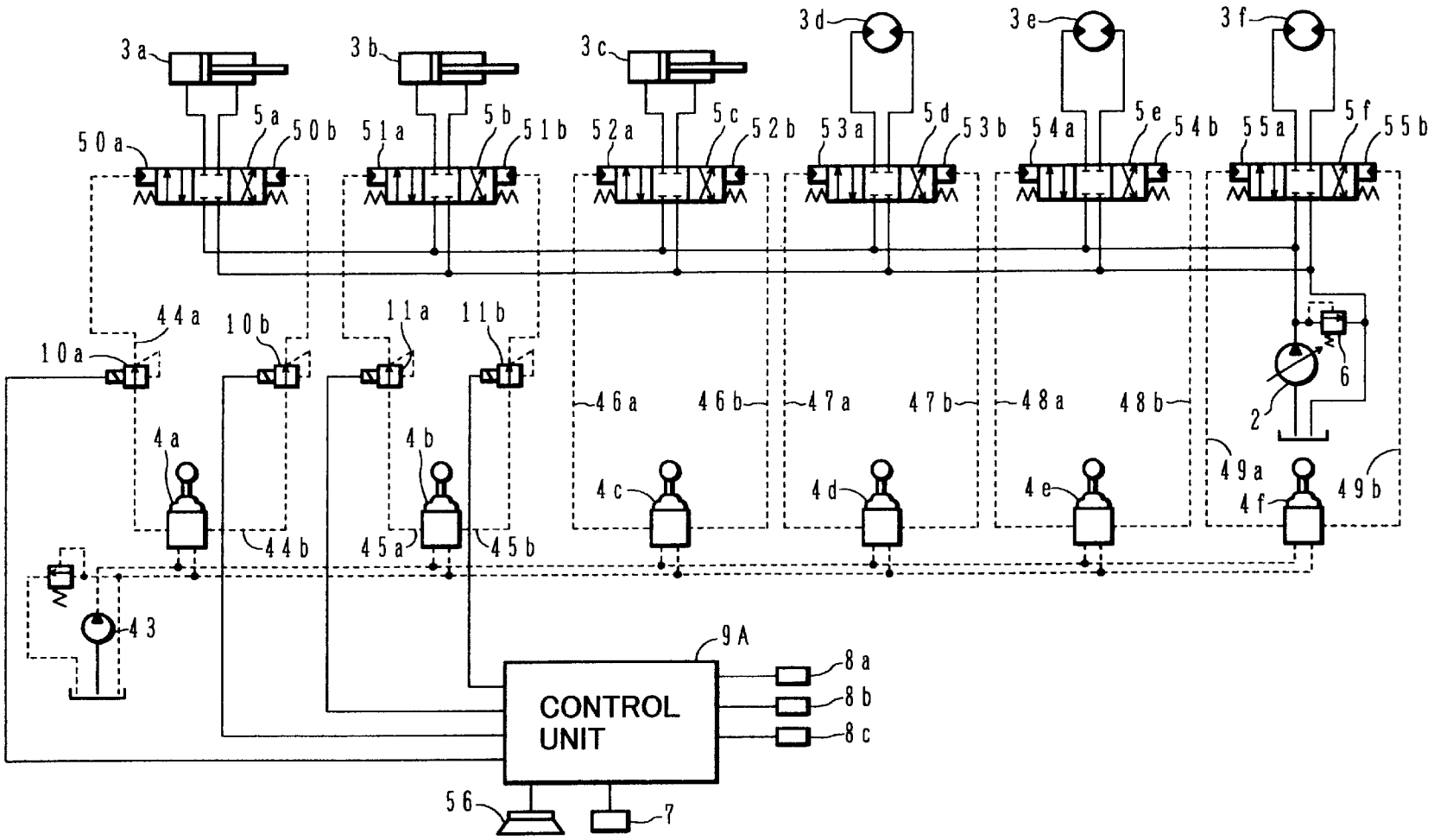
FIG. 11 is a diagram showing a work area limitation control system for a construction machine according to a second embodiment of the present invention, along with a hydraulic drive system thereof.

In FIG. 11, a work area limitation control system of this embodiment includes a buzzer 56 in addition to the arrangement of the first embodiment shown in FIG. 1. The buzzer 56 is turned on to produce sounds under control of a control unit 9A when a monitoring point set on the front device 1A comes close to a preset entrance forbidden area, thereby informing the operator of the presence of danger.

Figure 12:
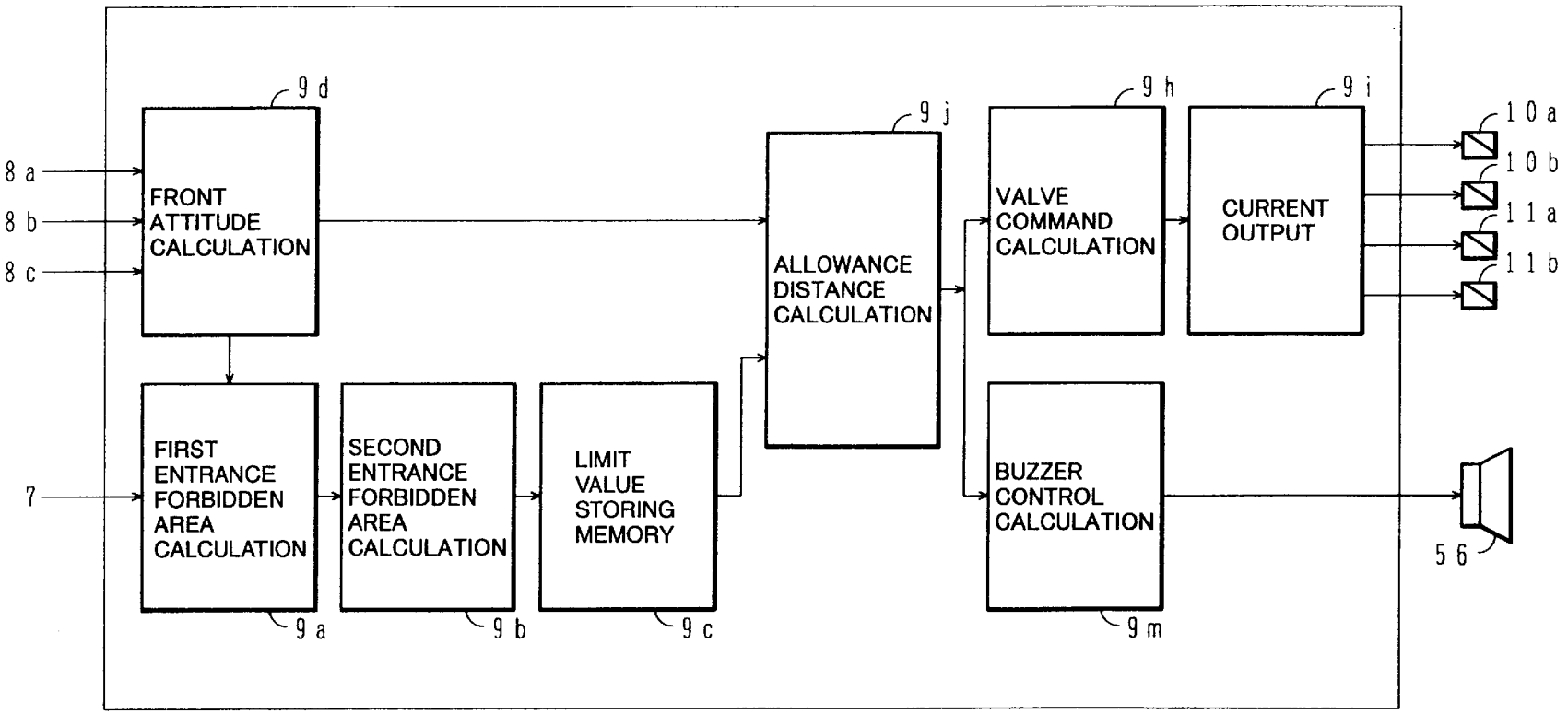
FIG. 12 is a functional block diagram showing control functions of a control unit according to the second embodiment.
Figure 13:
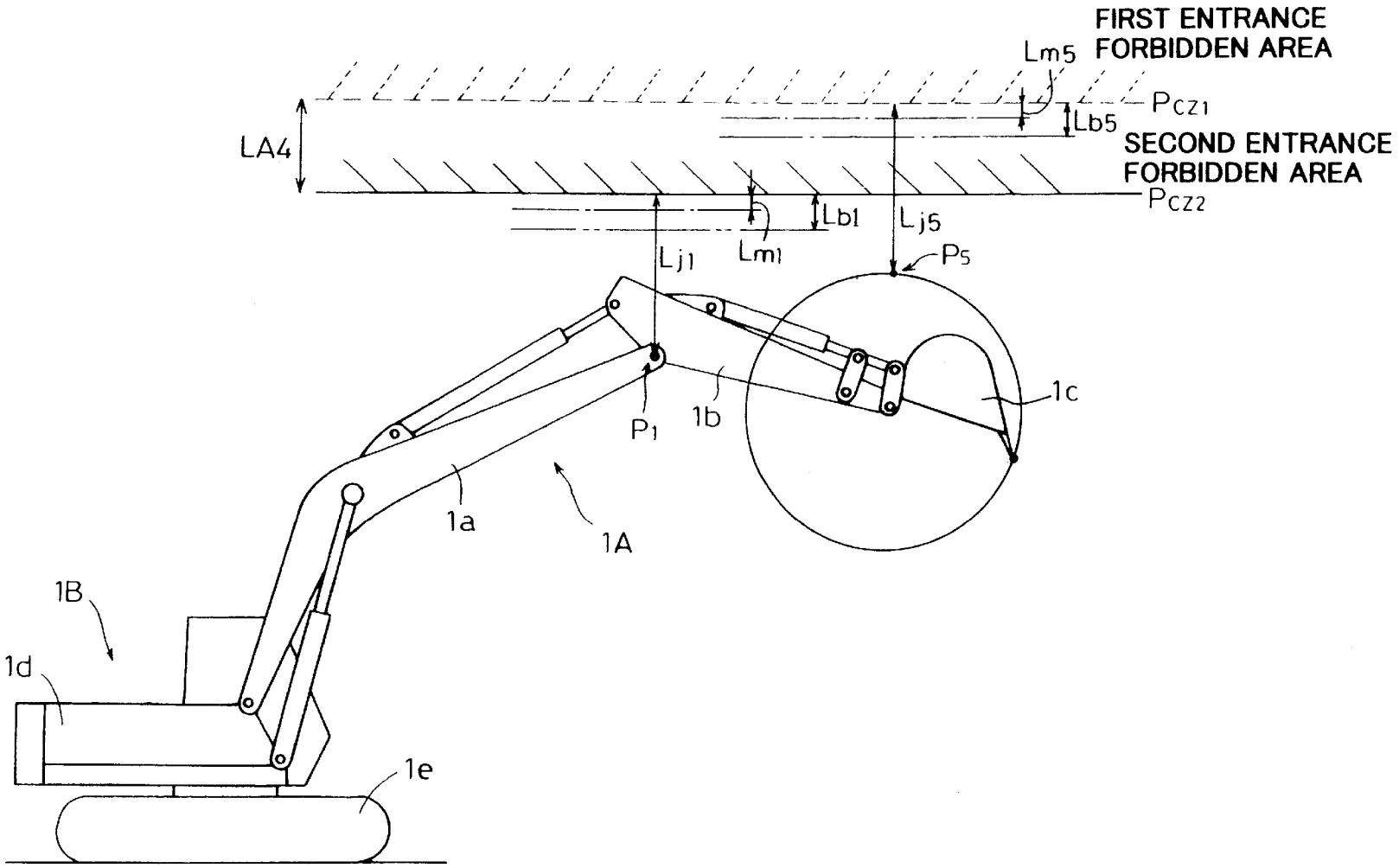
FIG. 13 is a view showing first and second entrance forbidden areas and set distances for use in the work area limitation control system of the second embodiment.

The control unit 9A has control functions as shown in FIG. 12. More specifically, the control unit 9A has functions executed by a first entrance forbidden area calculating portion 9*a*, a second entrance forbidden area calculating portion 9*b*, a limit value storing memory portion 9*c*, a front attitude calculating portion 9*d*, an allowance distance calculating portion 9*j*, a valve command calculating portion 9*h*, a current output portion 9*i*, and a buzzer control calculating portion 9*m*.

The functions of the first entrance forbidden area calculating portion 9*a*, the second entrance forbidden area calculating portion 9*b*, the limit value storing memory portion 9*c*, the front attitude calculating portion 9*d*, the current output portion 9*i* are the same as described above in connection with the first embodiment.

The allowance distance calculating portion 9*j* calculates a distance Lj1 between the monitoring point P1 and the second entrance forbidden area and a distance Lj5 between the monitoring point P5 and the first entrance forbidden area based on the Z-coordinate values P1z, P5z of the monitoring points P1, P5 calculated by the front attitude calculating portion 9*d* and the boundary values $P_{cz1}$, $P_{cz2}$ of the first and second entrance forbidden areas stored in the limit value storing memory portion 9*c*.

The valve command calculating portion 9*h* compares the distances Lj1, Lj5 calculated by the allowance distance calculating portion 9*j* with preset distances Lm1, Lm5 and, based on the compared results, calculates electric signals $i_{BU}$, $i_{BD}$, $i_{AC}$, $i_{AD}$ to be output to the electric pressure reducing valves 10*a*, 10*b*, 11*a*, 11*b*. Here, the distances Lm1, Lm5 are allowance distances with which the front device can be stopped without entering the first and second entrance forbidden areas in spite of a delay in the control system and so on, when the operator returns the control lever units to their neutral positions. The electric signals $i_{BU}$, $i_{BD}$, $i_{AC}$, $i_{AD}$ are calculated as follows.

(1) If Lj1≧Lm1 and Lj5≧Lm5;

$$i_{BU}=i_{MAX}$$

$$i_{BD}=i_{MAX}$$

$$i_{AC}=i_{MAX}$$

$$i_{AD}=i_{MAX}$$

Where $i_{MAX}$ is a current command value at which the maximum pilot pressure during slowdown is provided by a maximum pilot pressure (rated pilot pump pressure) in FIG. 9, i.e., a current value enabling each of the proportional solenoid valves 10*a*, 10*b*, 11*a*, 11*b* to be fully opened.

(2) If Lj1<Lm1 and Lj5≧Lm5;

$$i_{BU}=0$$

$$i_{BD}=i_{MAX}$$

$$i_{AC}=i_{MAX}$$

$$i_{AD}=i_{MAX}$$

where $i_{BU}=0$ means that the proportional solenoid valve 10*a* is fully closed.

(3) If Lj1≧Lm1 and Lj5<Lm5:

$$i_{BU}=0$$

$$i_{BD}=i_{MAX}$$

$$i_{AC}=i_{MAX}$$

$$i_{AD}=0$$

(4) If Lj1<Lm1 and Lj5<Lm5:

$$i_{BU}=0$$

$$i_{BD}=i_{MAX}$$

$$i_{AC}=i_{MAX}$$

$$i_{AD}=0$$

The buzzer control calculating portion 9*m* compares the distances Lj1, Lj5 calculated by the allowance distance calculating portion 9*j* with preset distances Lb1, Lb5 and, based on the compared results, calculates an electric signal to be output to the buzzer 56. Here, the distances Lb1, Lb5 are alarm distances used for alarming that the monitoring points P1, P5 have come close to the first and second entrance forbidden areas, respectively, and are set to meet Lb1>Lm1 and Lb5>Lm5. The electric signal is calculated as follows.

(1) If Lj1≧Lb1 and Lj5≧Lb5, the buzzer 56 is not turned on.

(2) If Lj1<Lb1 and Lj5<Lb5, the buzzer 56 is turned on to produce sounds intermittently.

Figure 14:
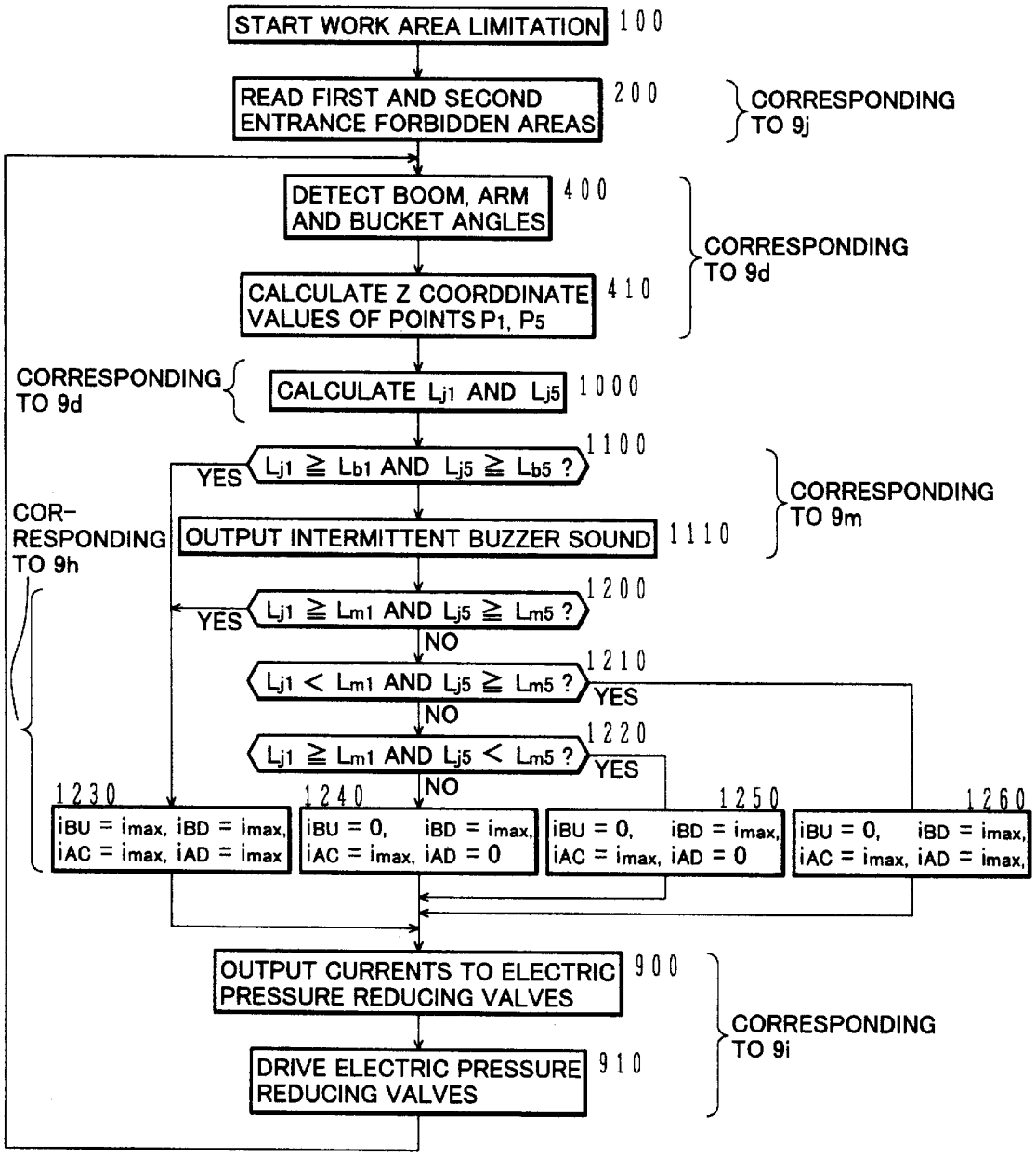
FIG. 14 is a flowchart showing processing procedures of the control unit.

The flow of the foregoing control process is shown in a flowchart of FIG. 14.

In FIG. 14, steps 400, 410 correspond to the front attitude calculating portion 9*d*, steps 200, 1000 correspond to the allowance distance calculating portion 9*j*, step 1100, 1110 correspond to the buzzer control calculating portion 9*m*, steps 1200–1260 correspond to the valve command calculating portion 9*h*, and steps 900, 910 correspond to the current output portion 9*i*.

In this embodiment with the second entrance forbidden area for the monitoring point P1 and the first entrance forbidden area for the monitoring point P5 set separately from each other, the boom-up operation is stopped when the monitoring point P1 is at the distance Lm1 from the second entrance forbidden area, but arm stop control is not effected unless the monitoring point P5 reaches the distance Lm5 from the first entrance forbidden area. As a result, a deterioration of maneuverability can be significantly suppressed.

Also, the boom operating speed becomes 0 immediately before the monitoring point P1 enters the second entrance forbidden area. But, since the second entrance forbidden area is set at a level lower than the first entrance forbidden area by LA4, the rear end of the arm will not enter the first entrance forbidden area even when the arm is moved after the boom has so stopped.

On the other hand, when the monitoring point P5 is at the distance Lm5 from the first entrance forbidden area, the boom and the arm are both controlled to stop, and the operating speeds of both the boom and the arm become 0 immediately before the monitoring point P5 enters the first entrance forbidden area. Therefore, the front device can be stopped without entering the first entrance forbidden area.

Further, when the monitoring point P1 is at the distance not larger than Lb1 from the second entrance forbidden area, or when the monitoring point P5 is at the distance not larger than Lb5 from the first entrance forbidden area, the buzzer 56 is turned on to produce intermittent sounds, thereby informing the operator that the monitoring point P1 or P5 will soon reach the entrance forbidden area. Accordingly, the operator can slow down the actuator by relieving the manipulation grip of the control lever, so that a shock produced upon the actuator being stopped may be abated.

It should be noted that the work area limitation control system of the present invention is not limited to the embodiments stated above, but can be modified in various ways. For example, while, in the foregoing embodiments, the angle sensors for detecting the rotational angles are employed as means for detecting the status variables relating to the position and attitude of the front device 1A, cylinder strokes may be detected instead. Also, while the foregoing embodiments have been described in connection with the case of performing the area limitation control over the head, the present invention is also similarly applicable to the case of setting an entrance forbidden area defined by a vertical or inclined boundary in the front of the vehicle body. Likewise, an entrance forbidden area may be set at a low level.

Further, while the present invention is practiced in the foregoing embodiments on an assumption that the first front member is a boom and the second front member is an arm, similar advantages can also be achieved with the present invention applied to the case where the first and second front members are an arm and a bucket.

Moreover, in the foregoing embodiments, the present invention is applied to a construction machine which is an ordinary hydraulic excavator with a front device having a mono-boom. But, the present invention is also similarly applicable to a hydraulic excavator with a front device having a two-piece boom or a hydraulic excavator with a front device having an offset. In such a case, similar advantages can also be achieved with the present invention applied to two booms of the two-piece boom or one boom of the two-piece boom and an arm in the former case and a boom and an offset or a boom and an arm in the latter case.

Additionally, while, in the foregoing embodiments, the present invention is applied to a hydraulic drive system in which flow control valves are driven by control lever units of hydraulic pilot type as described, similar advantages can also be achieved with the present invention applied to a hydraulic drive system using electric control lever units.

According to the present invention, it is possible to prevent a contact between front members and an obstacle without reducing maneuverability to the extent possible.

What is claimed is:

1. A work area limitation control system for a construction machine, said control system being equipped on the construction machine comprising a machine body, a multi-articulated front device made up of a plurality of front members including first and second front members connected to said machine body, a plurality of hydraulic actuators for driving said plurality of front members, a plurality of operating means for instructing operations of said plurality of front members, a plurality of flow control valves driven in accordance with operation signals input from said plurality of operating means for controlling flow rates of a hydraulic fluid supplied to said plurality of hydraulic actuators, said control system operating to cease supply of the hydraulic fluid to said hydraulic actuators to stop said front device when said front device reaches a preset first entrance forbidden area, wherein said control system comprises:

entrance forbidden area setting means for setting a second entrance forbidden area positioned closer to said front device than said first entrance forbidden area, and first operation signal modifying means for modifying the operation signals input from said operating means for said first and second front members such that immediately before a first monitoring point set on said second front member enters said second entrance forbidden area, said first front member is stopped, but said second front member is allowed to move into said second entrance forbidden area toward said first entrance forbidden area.

2. A work area limitation control system for a construction machine according to claim 1, wherein said first operation signal modifying means modifies the operation signal input from said operating means for said first front member such that when said first monitoring point comes close to said second entrance forbidden area, said first front member is slowed down.

3. A work area limitation control system for a construction machine according to claim 1, further comprising second operation signal modifying means for modifying the operation signals input from said operating means for said first and second front members such that immediately before a second monitoring point set on said front device enters said first entrance forbidden area, said first and second front members are both stopped.

4. A work area limitation control system for a construction machine according to claim 3, wherein said second operation signal modifying means modifies the operation signals input from said operating means for said first and second front members such that when said second monitoring point comes close to said first entrance forbidden area, said first and second front members are both slowed down.

5. A work area limitation control system for a construction machine according to claim 1, wherein said first and second front members are adjacent front members articulated with each other such that said second front member is pivotable relative to said first front member.

6. A work area limitation control system for a construction machine according to claim 1, wherein said first and second front members are a boom and an arm of a hydraulic excavator.

7. A work area limitation control system for a construction machine according to claim 1, wherein said entrance forbidden area setting means sets said second entrance forbidden area to be spaced from said first entrance forbidden area by a distance sufficient to prevent any part of said second front member from entering said first entrance forbidden area when said second front member is moved in a condition where said first monitoring point is positioned on a boundary of said second entrance forbidden area.

8. A work area limitation control system for a construction machine according to claim 1, wherein said plurality of operating means are of a hydraulic pilot type outputting pilot pressures as said operation signals, and said first operation signal modifying means includes pilot pressure modifying means for reducing the pilot pressure output from said operating means for said first front member down to a reservoir pressure immediately before said first monitoring point enters said second entrance forbidden area.

9. A work area limitation control system for a construction machine according to claim 3, wherein said plurality of operating means are of a hydraulic pilot type outputting pilot pressures as said operation signals, and said second operation signal modifying means includes pilot pressure modifying means for reducing the pilot pressures output from said operating means for said first and second front members down to a reservoir pressure immediately before said second monitoring point enters said first entrance forbidden area.

10. A work area limitation control system for a construction machine according to claim 8 or 9, wherein said pilot pressure modifying means includes electric pressure reducing valves disposed in pilot lines for transmitting the pilot pressures output from said operating means for said first and second front members to the associated flow control valves.

11. A work area limitation control system for a construction machine according to claim 1, wherein said entrance forbidden area setting means sets said second entrance forbidden area such that the second entrance forbidden area is positioned to extend along said first entrance forbidden area.

12. A work area limitation control system for a construction machine, said control system being equipped on the construction machine comprising a machine body, a multi-articulated front device made up of a plurality of front members including first and second front members connected to said machine body, a plurality of hydraulic actuators for driving said plurality of front members, a plurality of operating means for instructing operations of said plurality of front members, a plurality of flow control valves driven in accordance with operation signals input from said plurality of operating means for controlling flow rates of a hydraulic fluid supplied to said plurality of hydraulic actuators, said control system operating to cease supply of the hydraulic fluid to said hydraulic actuators to stop said front device when said front device reaches a preset first entrance forbidden area, wherein said control system comprises:

entrance forbidden area setting means for setting a second entrance forbidden area positioned closer to said front device than said first entrance forbidden area and to extend along the first entrance forbidden area, and first operation signal modifying means for modifying the operation signals input from said operating means for said first and second front members such that immediately before a first monitoring point set on said second front member enters said second entrance forbidden area, said first front member is stopped, but said second front member is allowed to move.

* * * * *